United States Patent [19]

Lawhorn et al.

[11] Patent Number: 4,537,371

[45] Date of Patent: Aug. 27, 1985

[54] SMALL CALIBER GUIDED PROJECTILE

[75] Inventors: William S. Lawhorn, Rockwall; Ivan L. Clinkenbeard, Euless, both of Tex.

[73] Assignee: LTV Aerospace and Defense Company, Dallas, Tex.

[21] Appl. No.: 412,827

[22] Filed: Aug. 30, 1982

[51] Int. Cl.[3] ..... F41G 7/00

[52] U.S. Cl. ..... 244/3.22

[58] Field of Search ..... 60/270.1; 244/31, 3.21, 244/3.22, 12.5; 137/808, 810, 832, 833; 210/801; 239/265.19

[56] References Cited

U.S. PATENT DOCUMENTS

| | | | |
|---|---|---|---|
| 2,624,281 | 1/1953 | McNally | 244/3.23 |
| 2,894,703 | 7/1959 | Hazen et al. | 137/808 |
| 3,091,924 | 6/1963 | Wilder | 244/3.22 |
| 3,208,383 | 9/1965 | Larson | 60/270.1 |
| 3,325,121 | 6/1967 | Banaszak et al. | 244/3.22 |
| 3,606,901 | 9/1969 | Thompson | 137/832 |
| 3,797,527 | 3/1974 | Bain | 137/833 |
| 3,806,063 | 4/1974 | Fitzgerald | 244/3.22 |
| 3,977,629 | 8/1976 | Tubeuf | 244/3.22 |
| 4,018,384 | 4/1977 | Fitzgerald et al. | 239/265.19 |
| 4,211,378 | 7/1980 | Crepin | 244/3.22 |
| 4,392,621 | 4/1979 | Viets | 244/12.5 |

OTHER PUBLICATIONS

IBM Technical Disclosure, B. J. Greenblott, *Fluid Controlled Device,* vol. 6, No. 5 (Oct. 1963).

*Primary Examiner*—Charles T. Jordan

*Attorney, Agent, or Firm*—S. S. Sadacca; J. M. Cate

[57] ABSTRACT

A small caliber guided projectile (20) includes a maneuvering unit (22) having a forward opening inlet (36) which provides diffused air to a flow control mechanism (70) prior to exhausting such air through diametrically opposed exhaust nozzles (74, 76). The flow control mechanism (70) includes a primary flow passageway (78) and an upper orifice switching device (100) for controlling bypass flow to one of the exhaust nozzles (76). An orifice switching device (120) controls bypass flow to the other exhaust nozzle (74). In one embodiment, a small, rearward facing step or other means of vortex generation, such as boundary layer energization, is located upstream of the discharge of the flow through switching devices into the nozzles. When the switching devices are closed, flow over the rearwardly facing steps generates a small vortex which enhances flow attachment as a result of the Coanda effect and increases flow through the nozzle. Opening of the orifice switching device results in aspiration through the nozzle, thereby impeding flow. By controlling the respective switching devices, flow through the opposed nozzles may be varied to produce a resultant lateral force on the projectile, permitting control of the trajectory of the projectile.

27 Claims, 5 Drawing Figures

SMALL CALIBER GUIDED PROJECTILE

TECHNICAL FIELD

The present invention relates to a small caliber guided projectile and particularly to a guided projectile using flow control means for the control of exhaust through opposing nozzles to provide lateral position corrections to the projectile.

BACKGROUND ART

Based on recent combat experiences, most tactical fighter air-to-air engagements occur at ranges less than the minimum effective range of present and developmental air-to-air missiles due to the Indentification Friend-or-Foe (IFF) problem at longer ranges. Therefore, the automatic cannon is a critical primary air-to-air aircraft armament.

Present airborne automatic cannon systems, however, suffer from rapidly degraded target hit probability with increased range. This is particularly the case where there is relative motion and acceleration between the launch platform and the target. Target hit probabilities have not been increased to acceptable levels by the use of advanced gun sights to provide lead angle prediction in real-time.

To improve the effectiveness of presently used cannon systems, high rates of fire gun systems have evolved. These systems, however, require large ammunition loadouts. Because airborne fighting vehicles, including tactical fighters and helicopters, have ammunition loadout limitations, the incorporation of larger ammunition loadouts is not possible on such vehicles. Moreover, the major benefit of increased ammunition loadout capacity is the opportunity to fire at more targets per sortie with no attendant increase in single-shot hit probability.

The present automatic systems also are greatly dependent on pilot skill. Thus, the successful development of a guided projectile in the 25 to 40 mm class which can be fired with precision terminal accuracy from an automatic cannon against a variety of targets offers the potential for quantum improvement in airborne cannon lethality, particularly where such a unit is not dependent on pilot skill levels.

Various thrust according and control features have been used in the past to guide projectiles including those disclosed in U.S. Pat. No. 2,624,281 to J. A. McNally; U.S. Pat. No. 3,091,924 to J. G. Wilder, Jr.; U.S. Pat. No. 3,208,383 to R. W. Larson; U.S. Pat. No. 3,325,121 to L. J. Banaszak, et al. and U.S. Pat. No. 3,806,063 to R. E. Fitzgerald. However, such methods and structures for thrust vectoring and guidance control are relatively complicated in design and are not readily adaptable to small caliber projectiles. Those designs which are adaptable to small caliber projectiles fail to provide the degree of control required.

In many cases, prior art systems have also required an onboard chemical energy propellant which adds to the weight and complexity of the missile and tends to increase the storage and handling requirements. Systems which are dependent upon such a propellant source carried onboard the missile necessarily face problems related to fuel exhaustion and shift in center of mass as fuel is used. These systems also introduce the additional complexity associated with the necessary ignition and fuel supply systems.

DISCLOSURE OF THE INVENTION

The present invention is to a small caliber guided projectile system including a maneuvering projectile coupled to a propulsion means. The maneuvering projectile components include an outer structure, a control mechanism, guidance command receiver, power supply, avionics, obturator, explosive mechanism and safe/arm fuse device.

The propulsion means consists of either a cartridge or separating booster. The cartridge is composed of a case, propellant and primer. The separating booster includes a case, propellant, igniter and safe/arm device.

In one embodiment of the invention, the guided projectile includes a projectile housing having spaced divertently oriented guidance nozzles mounted therein with an air inlet for supplying air to the bifurcated guidance nozzles. Flow control structure is associated with each nozzle for selectively controlling air flow therethrough to permit imput of lateral forces to the projectile by the control of such flow. In the primary embodiment of the invention, the inlet is an external compression, two shock forward opening inlet and diffuser combination which channels supersonic free stream ram air through the projectile housing for selective discharge through the guidance nozzles to control the projectile.

The guided projectile of the present invention incorporates dual opposing nozzles in a single plane with a switching concept to control lateral forces on the projectile. By the control of the flow of air through the guidance nozzles, lateral position corrections are provided to the projectile. The air mass used to control the projectile is ingested by an annular, forward facing, inlet and is alternately expelled through the opposing exhaust nozzles at a frequency which can accommodate high projectile spin rates.

In a preferred embodiment of the invention, flow through the exhaust nozzles moves past a rearward facing step which serves to generate a small vortex for triggering a boundary attachment flow as a result of the Coanda effect. Small aspiration orifices having a fluidic switch for controlling flow therethrough bleed a small amount of air from flow through the projectile to a point immediately downstream of the rearward facing step.

Where both nozzle switching devices are initially open, flow through both nozzles will be separated from the nozzle walls adjacent to the aspiration orifices and no net normal force will result from the flow through the exhaust nozzles. With the closure of one of the orifices, aspiration ceases and small vortex formation occurs, resulting in flow attachment with associated entrainment along the wall of the "active" nozzle. As a result, a net normal force is imparted on the projectile. Rapid control reversal is accomplished by merely closing the opened orifice switch associated with the "active" exhaust nozzle and opening the switch in the opposite orifice. As a result of this switching, flow separation occurs in the "active" nozzle to make it "inactive" and flow attachment with associated entrainment along the wall of the opposite exhaust nozzle results. Thus, a reversal of the normal force on the projectile is accomplished.

In one embodiment of the invention, air flow through the switching orifices is regulated by piezoceramic valves which respond to signals received from an external guidance system such as a beam rider optical system controlled by a tracking aircraft or similar deployment platform. Alternatively, solenoid valves actuating fluidic pin amplifiers are used to control air through the switching orifices.

BRIEF DESCRIPTION OF THE DRAWINGS

For a more complete understanding of the present invention, and for further details and advantages thereof, reference is now made to the following Detailed Description taken in conjunction with the accompanying Drawings, in which.

DETAILED DESCRIPTION

Figure 1:
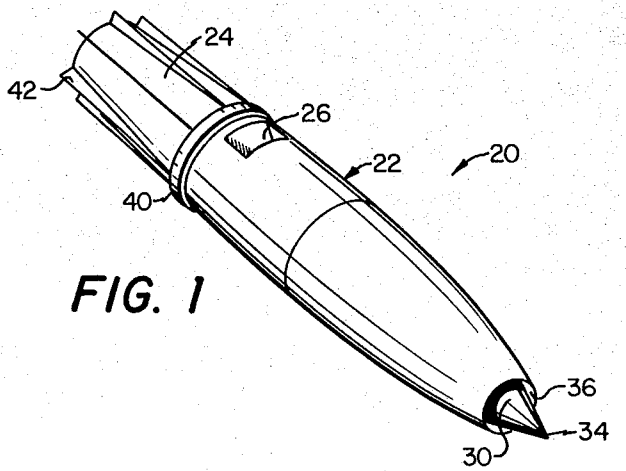
FIG. 1 is a perspective view of a small caliber guided projectile embodying the present invention.

Referring to FIG. 1, the small caliber guided projectile 20 includes a forebody and mid-body assembly housing the maneuvering unit 22 with a boattail assembly 24 attached to the aft end of the maneuvering unit. Maneuvering unit 22 includes a pair of diametrically opposed exhaust nozzle openings 26. An explosive mechanism 30 is mounted within the forebody assembly of the maneuvering unit 22 and has a spike end 34 which projects forwardly through a forward opening inlet 36 is maneuvering unit 22.

Boattail assembly 24 is attached to maneuvering unit 22 at an obturator 40 and has a plurality of fixed fins 42 equally spaced circumferentially around cartridge 24. In the embodiment shown, eight fins 42 are incorporated to form an octagonal arrangement.

Figure 2:
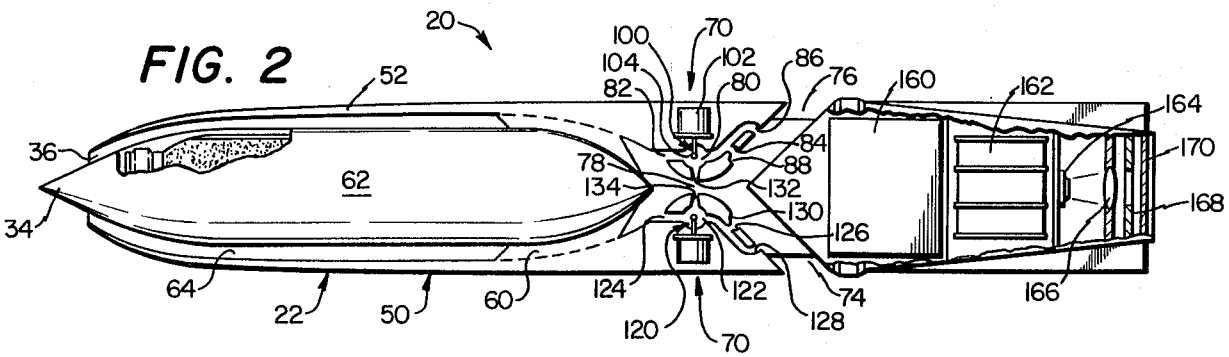
FIG. 2 is an enlarged vertical section view of the guided projectile.

Referring to FIG. 2, a partial vertical section of the guided projectile 20 is shown with various components partially broken away to fully disclose the invention. Maneuvering projectile 22 includes an outer housing 50 with an inlet cowl 52 defining forward opening inlet 36. A plurality of spike support vanes 60 extends radially inwardly from inlet cowl 52 and receives an explosive mechanism 62 thereon. Explosive mechanism 62 has a spike end 34 which extends forwardly through inlet 36. An annular inlet passage 64 is defined between explosive mechanism 62 and the inside wall of inlet cowl 52. Diffused air entering inlet 36 and flowing through passage 64 passes through a flow control mechanism 70 and then through diametrically opposed nozzles 74 and 76. As can be seen in FIG. 1, these nozzles communicate with exhaust openings 26 in the side wall of maneuvering unit 22.

Flow control mechanism 70 includes a primary flow passageway 78 which communicates flow from inlet 36 through exhaust nozzles 74 and 76. An upper passageway 80 communicates between a directing port 82 upstream of passageway 78 and a pair of spaced nozzle aspiration orifices 84 and 86. Both orifices 84 and 86 are formed in nozzle 76. Orifice 84 is downstream of a rearwardly facing step 88, and orifice 86 is downstream of orifice 84. Aspiration orifice 86 prevents secondary flow reattachment and resultant partial entrainment which could occur downstream of aspiration orifice 84.

Figure 4:
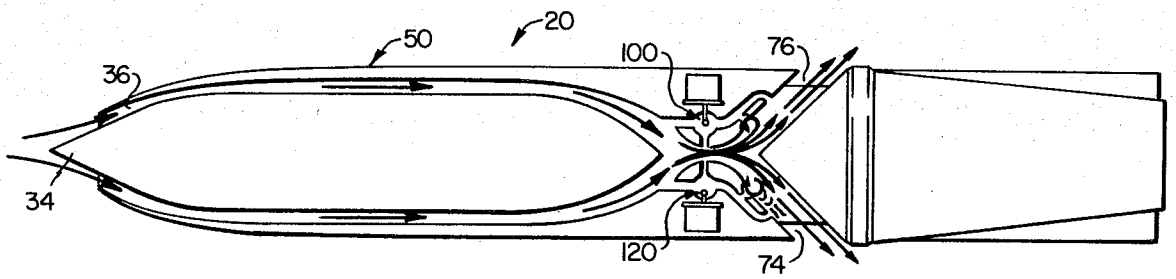

An orifice switching device 100 is selectively switchable to close flow through nozzle aspiration orifices 84 and 86. Switching device 100 includes a high bandwidth solenoid 102 controlling a pin amplifier 104. Pin amplifier 104 is movable between the position shown in FIG. 2 wherein the nozzle aspiration orifices are open to flow through passageway 80 to a closed position as shown in FIG. 4.

Similarly, an orifice switching device 120 is selectively operable to control the flow of air through passageway 122 communicating from opening 124 and nozzle aspiration orifices 126 and 128 at nozzle 74. A rearwardly facing step 130 is defined in the forward wall of nozzle 74 immediately upstream of orifice 126. Orifice 128 is downstream of orifice 126. Switching device 120 is identical in construction and operation to switching device 100, the two switching devices being controllable to vary the flow through nozzles 74 and 76 and thus control the trajectory of the projectile.

Boattail assembly 24 includes a thermal battery power supply 160 and a thick-film hybrid leadless carrier electronic microprocessor 162 immediately aft of battery 160. An uncooled monolithic electrooptical detector 164 is mounted aft of microprocessor 162 having appropriate optical lens 166. A Stimson retro-reflector 168 and polarizing filter 170 are mounted in a parallel arrangement at the aft end of boattail 24.

In the present invention, fluidics is used to achieve control switching to vary the flow through nozzles 74 and 76 to provide lateral position corrections along the projectile's trajectory. In the stage shown in FIG. 2, orifice switching devices 100 and 120 are in their open position, thereby permitting flow through passageways 80 and 122, respectively, and through nozzle aspiration orifices 84 and 86 into nozzle 76 and through aspiration orifices 126 and 128 into nozzles 74. A positive static pressure gradient between the directing ports 82 and 124 and the primary flow passageway 78 results from choking action of the flow at passageway 78. Small static pressure orifices 132 and 134, respectively, at the top and bottom of primary passageway 78 insure a tendency of flow to occur in passageways 82 and 122 whenever switching devices 100 and 120 are in the open position. As a result, the flow of small amounts of diffuser air from inlet 36 into nozzles 74 and 76 cause flow separation adjacent the forward boundary of the nozzles. With both orifices initially open, equal, though restricted, flow is exhausted through exhaust nozzles 26, thereby providing no resultant lateral force on the projectile.

Figure 3:
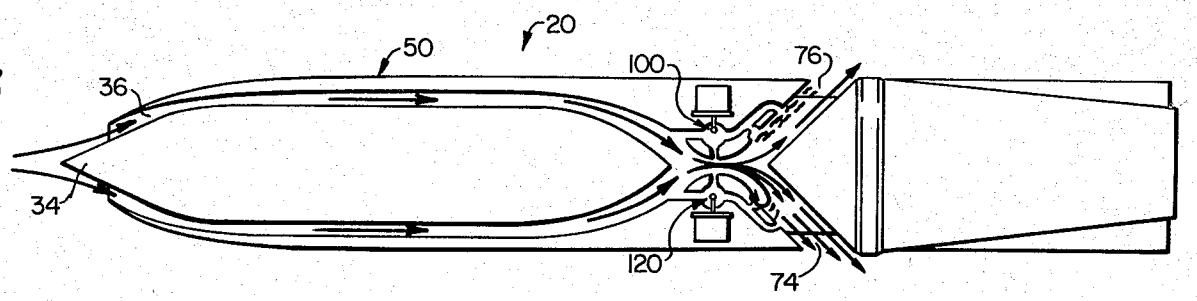
FIGS. 3–5 are vertical sections showing the sequence of switching operations used in controlling the trajectory of the projectile.

As is shown in the sequence illustrated in FIG. 3, a resultant upward normal force is applied to the projectile by closing orifice switching device 120. Closure of switching device 120 prevents the flow of air into nozzle 74 through aspiration orifices 126 and 128. Flow through nozzle 74 by way of central passageway 78 attaches to the forward boundary of the exhaust nozzle as a result of the formation of a small vortex, generally termed Coanda bubble, generated by air flow across rearward facing step 130. This small vortex in turn triggers the Coanda effect which results in full attachment with associated entrainment. The control at this point produces a net normal force in the upward direction.

Figure 5:
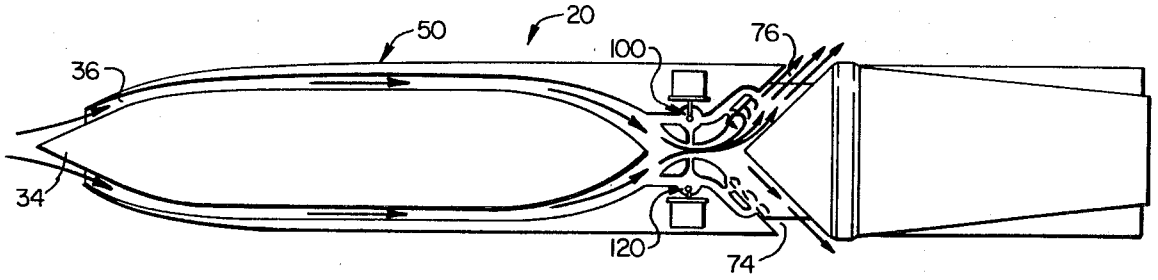

FIGS. 4 and 5 illustrate simultaneous switching of both orifice switching devices 100 and 120. Switching device 100 is closed and switching device 120 is opened. This switching results in a rapid control reversal due to vortex growth and flow separation caused by aspiration in lower nozzle 74 coupled with small vortex formation downstream of rearward facing step 88 in nozzle 76 and the associated attachment and entrainment in upper nozzle 76. In this instance, the control produces a net downward force. Fluidic control switching is stable in nature because no reversal or loss of control will occur until the position of the orifice switching device is changed.

The present guided projectile is spin stabilized, thereby removing the requirement for mechanically risky, weight-adding, folding fins. The use of free-stream ram air for maneuvering requires no stored chemical energy and alleviates the technical risks associated with pyrotechnic or squib maneuvering devices, reduces possible payload attenuation due to propellant storage volume and removes the danger of control exhaustion before target impact. The air flow through the orifice switching devices is regulated by solenoid or piezoceramic valves which respond to signals received from an external guidance system such as a beam rider optical system controlled by tracking aircraft or similar deployment platform. Solenoid valves are favored for the control mechanism for switching devices 100 and 120. Although not as responsive as piezoelectric devices, solenoid valves have a greater inherent ability to survive a 60,000-g gun launch setback and operate at elevated temperatures. Solenoids have been designed and tested with responses in excess of 2,000 Hz.

The present system also provides for accurately switching the control precisely when needed at a very high control bandwidth to achieve maneuvering in the desired direction. The present fluidic methods have the potential for ultra high bandwidth, up to 10,000 Hz, and extremely high input amplication, up to 1,000:1 without the undesirable effect of inlet unstarts caused by flow restriction through the projectile as would be associated with mechanical flow control. For example, valves or other mechanical devices used to restrict or stop flow through the projectile would cause repeated high frequency inlet unstarts. This restrictive flow would be highly undesirable from the standpoint of projectile drag and control time delays associated with inlet restart (normal shock swallowing) phenomenon. Such problems are overcome by employing the fluidic switching as incorporated in the present invention.

Thus, the present guided projectile employs dual guidance or exhaust nozzles which alternately expel air in opposite directions to provide lateral position corrections along the projectile trajectory. The air mass used to control the projectile is ingested through an annular forward facing inlet and is expelled in a controlled manner through the opposing exhaust nozzles at a frequency which corresponds to the projectile's spin rate. A fluidic switching concept is employed to enhance internal air flow to the desired nozzle by opening and closing small orifices located forward of the exhaust nozzles. These orifices, in conjunction with small vortex generators, enhance flow attachment along the wall of the preferred nozzle as a result of the Coanda effect. The air flow through the switching orifices is regulated by solenoid or piezoelectric valves which respond to signals received from an external guidance system.

By opening valves associated with both exhaust nozzles, equal flows are directed to the main valve control ports, causing the main valve jet to remain symmetrical and consequently be divided equally out of the nozzles. By opening one valve and closing the opposite valve, a maximum deflection of the main jet results and maximum thrust in one direction is obtained. Thrust in the opposite direction is obtained by reversing the valve control.

Although preferred embodiments of the invention have been described in the foregoing Detailed Description and illustrated in the accompanying Drawings, it will be understood that the invention is not limited to the embodiments disclosed, but is capable of numerous rearrangements, modifications and substitutions of parts and elements without departing from the spirit of the invention. Accordingly, the present invention is intended to encompass such rearrangements, modifications and substitutions of parts and elements as fall within the spirit and scope of the invention.

We claim:

1. A guided projectile comprising:

a projectile housing with diametrically opposed divergently oriented guidance nozzles mounted therein;

a supersonic external compression air inlet and subsonic diffuser for supplying air to the guidance nozzles; and flow control means for selectively diverting air flow through said nozzles permitting input of lateral forces to the projectile, said flow control means comprising a bifurcated discharge arrangement with vortex generator means for generating a small vortex within each nozzle and downstream of said generator means to cause flow entrainment and attachment to the wall of the nozzle, thereby increasing flow through a selected one of said nozzles, said flow control means further comprising a valve for selectively directing air into the non-selected nozzle downstream of said vortex generator means to permit aspiration and prevention of flow attachment to the boundary wall of the non-selected nozzle to impede flow through the nozzle.

2. The guided projectile according to claim 1 wherein said inlet is a forward opening inlet.

3. The guided projectile according to claim 1 further comprising control means for controlling said valve to vary flow through said nozzle and control the lateral force on the projectile.

4. The guided projectile according to claim 1 further comprising means for selectively switching said valve from an open to a closed position in response to guidance control means for controlling the trajectory of the projectile.

5. The guided projectile according to claim 1 wherein said vortex generator means comprises a rearward facing step for generating a small vortex in the nozzle to cause flow entrainment and attachment to the wall of the nozzle.

6. The guidance nozzle according to claim 5 wherein said flow control means further comprises a controllable valve for selectively directing air into the guidance nozzle downstream of said rearward facing step to prevent flow attachment to the boundary wall of the nozzle to impede flow through the nozzle.

7. The guided projectile according to claim 6 further comprising means for selectively switching said valve from an open to a closed position in response to guidance control means for controlling the trajectory of the projectile.

8. The guided projectile according to claim 1 wherein said nozzles have adjacent inlets and exhaust on opposite sides of said projectile, both nozzles receiving flow from the forward opening inlet such that impedance of flow through one nozzle increases flow through the other.

9. The guided projectile according to claim 1 further comprising an explosive mechanism concentrically mounted within said housing with said inlet formed around said explosive mechanism.

10. The guided projectile according to claim 1 wherein said projectile comprises two guidance nozzles mounted on opposite sides of said housing and directed outwardly at a fixed selected angle from the longitudinal axis of the projectile housing.

11. A method of guiding a projectile comprising:

directing air from a supersonic inlet to a pair of guidance nozzles oriented at a predetermined angle to the longitudinal axis of the projectile; and selectively controlling flow through said nozzles to control the trajectory of the projectile by generating a flow attaching vortex in a selected one of said guidance nozzles to cause flow attachment to the wall of the nozzle and simultaneously preventing vortex formation in the other nozzle, thereby increasing flow through the selected nozzle.

12. The method according to claim 11 wherein said prevention of vortex formation comprises:

aspirating flow through the non-selected nozzle to prevent the development of a flow attaching vortex therein to impede flow therethrough.

13. The method according to claim 12 wherein said aspirating step comprises:

selectively diverting a portion of the inlet air through a valve means and reintroducing said air downstream in one of said nozzles.

14. The method according to claim 11 wherein said step of controlling flow through the nozzle includes generating a flow attaching vortex in the nozzle using a rearward facing step near the mouth of the nozzle to generate a small vortex downstream thereof to cause flow attachment to the wall of the nozzle, thereby increasing flow through the nozzle.

15. The method according to claim 14 wherein said step of controlling flow through the nozzle further comprises controlling the flow of fluid adjacent said rearward facing step to control the development of a flow attachment vortex in the nozzle.

16. The method according to claim 11 further comprising:

selectively bleeding a portion of air from the inlet through valve means for preventing the generation of a vortex in one of the guidance nozzles to control flow through said nozzle, thereby imparting a lateral guiding force on the projectile.

17. The method according to claim 16 further comprising:

controlling the bleeding of air through the valve means to said guidance nozzles to control the direction of said projectile.

18. The method according to claim 16 wherein said step of selectively bleeding of air through the valve means comprises controlling a valve structure in a bypass orifice.

19. A method of guiding a projectile comprising:

channeling inlet air past a vortex generator to selectively generate a vortex prior to exhausting the air through a first and second guidance nozzle, said vortex generation causing the enhancement of flow through the guidance nozzle; and selectively diverting air through a bistatic controllable valve means to a point downstream of the vortex generator and into the flow through the non-selected guidance nozzle, said injection preventing the generation of a vortex in the non-selected guidance nozzle to impede flow therethrough and direct flow through the selected nozzle, thereby imparting a lateral force on the projectile.

20. The method according to claim 19 wherein the vortex generation is accomplished by passing air from the inlet over a rearwardly facing step mounted adjacent to the guidance nozzle inlet.

21. The method according to claim 19 further comprising:

selectively switching said valve means from an open to a closed position in response to guidance control means to control the trajectory of the projectile.

22. A guided projectile comprising:

a projectile housing with diametrially opposed divergently oriented guidance nozzles mounted therein;

a supersonic external compression air inlet for supplying air into said projectile housing;

means for diverting said air through one of or dividing substantially equally between said divergently oriented guidance nozzles;

means for generating and controlling the formation of a vortex in one or preventing vortex generation in both of said nozzles downstream of said diverting means for causing either flow attachment to the wall of a selected nozzle thereby entraining all inlet flow through said selected nozzle to control the lateral force on the projectile or permitting division of the flow between the nozzles to negate lateral forces and thereby guide the projectile, said generating and controlling means further comprising a bistatic fluidically controlled valve for selectively directing an amount of air into a non-selected one of the guidance nozzles downstream of said vortex generator means to aspirate and thereby prevent flow attachment to the boundary wall of said non-selected nozzle to impede flow through the nozzle.

23. The guided projectile according to claim 22 further comprising control means for controlling said valve to control flow through said nozzle and control the lateral force on the projectile.

24. The guided projectile according to claim 22 further comprising means for selectively switching said valve to either one or the other of said nozzles to impede flow through the non-selected nozzle or closing said valve to both said nozzles to permit equal flow through both of said nozzles in response to guidance control means for controlling the trajectory of the projectile.

25. The guided projectile according to claim 22 wherein said vortex generator means comprises a rearward facing step for generating a small vortex in the nozzle to cause flow attachment to the wall of the nozzle.

26. The guidance nozzle according to claim 25 wherein said flow control means further comprises a bistatic fluidically controlled valve for selectively directing air into a non-selected one of the guidance nozzles downstream of said rearward facing step to aspirate and thereby prevent flow attachment to the boundary wall of said selected nozzle to impede flow through the nozzle.

27. The guided projectile according to claim 26 further comprising means for selectively switching said valve to either one or the other of said nozzles to impede flow through the non-selected nozzle or to permit equal flow through both of said nozzles in response to guidance control means for controlling the trajectory of the projectile.

* * * * *